US011123728B2

(12) United States Patent
Jones

(10) Patent No.: US 11,123,728 B2
(45) Date of Patent: Sep. 21, 2021

(54) FAST SAMPLE LOADING MICROFLUIDIC REACTOR AND SYSTEM

(71) Applicant: IMEC VZW, Leuven (BE)

(72) Inventor: Benjamin Jones, Kessel-Lo (BE)

(73) Assignee: IMEC VZW, Leuven (BE)

( * ) Notice: Subject to any disclaimer, the term of this patent is extended or adjusted under 35 U.S.C. 154(b) by 404 days.

(21) Appl. No.: 16/217,459

(22) Filed: Dec. 12, 2018

(65) Prior Publication Data

US 2019/0201893 A1 Jul. 4, 2019

(30) Foreign Application Priority Data

Dec. 28, 2017 (EP) ..... 17210767

(51) Int. Cl.
*B01L 3/00* (2006.01)

(52) U.S. Cl.
CPC ..... *B01L 3/502715* (2013.01); *B01L 3/5027* (2013.01); *B01L 3/502738* (2013.01); *B01L 2200/0621* (2013.01); *B01L 2200/10* (2013.01); *B01L 2200/141* (2013.01); *B01L 2200/16* (2013.01); *B01L 2300/0819* (2013.01); *B01L 2300/0867* (2013.01); *B01L 2400/06* (2013.01); *B01L 2400/0622* (2013.01); *B01L 2400/08* (2013.01)

(58) Field of Classification Search
CPC ..... C12Q 1/6869; C12Q 2565/629; B01L 3/502715; B01L 3/5027; B01L 3/502738; B01L 2200/10; B01L 2200/141; B01L 2200/16; B01L 2300/0819; B01L 2300/0667; B01L 2400/06; B01L 2400/0622; B01L 2400/08
See application file for complete search history.

(56) References Cited

U.S. PATENT DOCUMENTS

| | | | | |
|---|---|---|---|---|
| 8,252,160 | B2 * | 8/2012 | Harding | B01L 3/502707 204/500 |
| 2009/0268548 | A1 | 10/2009 | Hartmann et al. | |
| 2014/0017806 | A1 * | 1/2014 | Lee | B01L 3/502753 436/180 |
| 2016/0137963 | A1 * | 5/2016 | Eriksen | B01L 3/502746 435/91.5 |

FOREIGN PATENT DOCUMENTS

| | | | |
|---|---|---|---|
| EP | 2444157 | A1 | 4/2012 |
| EP | 2572788 | A1 | 3/2013 |
| WO | 2006/098696 | A1 | 9/2006 |

OTHER PUBLICATIONS

Wiktor, Peter et al., "Microreactor Array Device", Scientific Reports, vol. 5:8736, Mar. 4, 2015, pp. 1-8.
Srivannavit, Onnop et al., "Microfluidic Reactor Array Device for Massively Parallel In-situ Synthesis of Oligonucleotides", Sens Actuators B Chem., vol. 140, No. 2, Jul. 2009, pp. 1-20.

* cited by examiner

*Primary Examiner* — David C Thomas
(74) *Attorney, Agent, or Firm* — McDonnell Boehnen Hulbert & Berghoff LLP

(57) ABSTRACT

Example embodiments relate to fast sample loading microfluidic reactors and systems. One embodiment includes a microfluidic device. The microfluidic device includes a reaction chamber allowing reacting of at least one fluid material. The microfluidic device also includes at least two fluidic channels coupled to the reaction chamber for providing a fluid to and exiting a fluid from, respectively, the reaction chamber. Each fluidic channel includes an inlet and an outlet. Each fluidic channel is configured such that when a first fluid is provided in the reaction chamber via that fluidic channel, the first fluid exits the reaction chamber via the outlet of at least one other fluidic channel when the reaction chamber is filled, thereby preventing a second fluid from the at least one other fluidic channel, when present in the inlet, from diffusing into the reaction chamber.

17 Claims, 13 Drawing Sheets

Part I: Initialize the Problem

Boundary Conditions

$V_{wash}$ = 10 mm/s
$V_A$ , $V_B$ = 0

Fluid Flow (Navier-Stokes Equations)

Solve for steady-state solution

Species Concentration (Advection-Diffusion Equations)

Solve for steady-state solution along with fluid flow

Part II: Solve for Fluid Flow during Species A Introduction

Boundary Conditions

$V_B$ = 10 mm/s
$V_{wash}$ , $V_A$ = 0

Fluid Flow (Navier-Stokes Equations)

Solve for steady-state solution

Species Concentration (Advection-Diffusion Equations)

Solution from part I is not updated during this step

Part III: Solve for Time-Dependent Species Concentration

Boundary Conditions

$V_B$ = 10 mm/s
$V_{wash}$ , $V_A$ = 0

Fluid Flow (Navier-Stokes Equations)

Solution from part II is not updated during this step

Species Concentration (Advection-Diffusion Equations)

Solve for time-dependent solution using solution of species concentration from part I as initial conditions

FIG. 7C

FAST SAMPLE LOADING MICROFLUIDIC REACTOR AND SYSTEM

CROSS-REFERENCE TO RELATED APPLICATIONS

The present application is a non-provisional patent application claiming priority to European Patent Application No. EP 17210767.4, filed Dec. 28, 2017, the contents of which are hereby incorporated by reference.

FIELD OF THE DISCLOSURE

The present disclosure relates to the field of microfluidic devices. More particularly it relates to a microfluidic reactor allowing accurate control of reagents input and outflow so that high purity reactions can be obtained.

BACKGROUND

One of the challenges when using microfluidic systems is to combine the use of small volumes of fluids, while allowing for high purity reactions. The relevance of traces of impurities is relatively more important when using small liquid volumes. Examples of applications where high purity reactions are required include but are not limited to DNA sequencing and synthesis of biomolecules such as oligonucleotides.

DNA sequencing will be discussed in some detail to provide background of one potential application of example embodiments. This does not imply that DNA sequencing is the only potential application of example embodiments. It is also not the purpose here to provide a comprehensive review of the subject of DNA sequencing as this would be too lengthy. For brevity and conciseness, not every possible use of example embodiments will be described here.

In whole genome sequencing, it may be beneficial to know the sequence of the nucleotides in a patient's DNA. There are a number of techniques for determination of the DNA sequence. DNA sequencing by synthesis is an example of a class of techniques that works by taking a single-stranded DNA (ssDNA) template and building the double-stranded DNA (dsDNA) molecules by incorporating the nucleotides adenine (A), cytosine (C), guanine (G), and thymine (T) in a particular order by a reaction. The incorporation of a nucleotide into the ssDNA produces pyrophosphate (PPi), which is detectable using a number of methods. Pyrosequencing, for example detects light emitted during a sequence of enzymatic reactions with the PPi. So in order to determine which nucleotide is incorporated into the ssDNA, each nucleotide should typically be introduced one at a time into the reaction chamber at high levels of purity. Otherwise, an incorrect read of the nucleotide being incorporated might occur.

To perform whole genome sequencing by synthesis, the DNA is split into small fragments, each containing typically a few hundred or a few thousand base-pairs. These fragments are then spread over a large number of reactors so that the process of sequencing can be massively parallelized. To give the reader some sense of scale, there are approximately 3 billion base-pairs in the human genome so 3 million reactor cavities are nominally required if the DNA is fragmented into 1000 base-pair segments and each reactor contains a distinct, different DNA fragment. In reality more reactions are used to ensure data integrity when piecing back together the DNA from reading the nucleotide sequence from the multiple DNA fragments. Furthermore, it is difficult to ensure that each reactor is loaded with a distinctly, different fragment of the whole genome.

The classical technology for whole genome sequencing utilizes a relatively large flow cell which contains a large number of reaction cavities. The ssDNA template fragments are typically either covalently bound directly to the surface of each reaction cavity or bound to beads that are placed into each reaction cavity. Because the flow cell is large, it takes some time to fill the flow cell with a nucleotide and then evacuate the flow cell of the nucleotide using a wash buffer before introduction of the next nucleotide. So the rate at which nucleotides can be introduced and incorporated into the ssDNA is relatively slow. Also, a large amount of reagents are typically used during this sequencing operation.

The process of introducing the reagents sequentially can be sped up by introducing the separate reagent inlet channels and outlet channel very close to each reaction chamber by using microfluidic channels. Here, the problem is preventing diffusion of unwanted reagents (nucleotides in the case of DNA sequencing) into the reaction chamber, which reduces the purity of reagents and can cause unwanted reactions to occur (incorporation of the wrong nucleotide in the case of DNA sequencing).

Whereas a washing buffer channel may be provided for removing remaining reagent from the reaction chamber, which allows cleaning the reaction chamber in between different reactions, such washing buffer cleaning does not prevent that reagents diffuse back into the reactor chamber. To avoid this, conventionally for each reagent inlet channel a valve is provided, which is opened for allowing a reagent to enter the reaction chamber and which is closed when the reagent is not to enter the reaction chamber, thus avoiding diffusion into the reaction chamber. This, nonetheless, increases the size and complexity of the system considerably.

Additionally, the presence of valves requires a control system for opening and closing the valves, which also increases the complexity, size and cost of the microfluidic system. Valves usually use mechanical parts, which are prone to failure and reduces resilience of the system. Additionally, opening and closing the valves take time, which can increase operation times.

SUMMARY

Some embodiments to provide a compact microfluidic reactor for providing microfluidic reactions with high purity.

In some embodiments, a system is provided that allows fast load of reagents and unload of waste. In some embodiments, reactions can be performed with a high throughput.

In some embodiments, a microfluidic system is provided that does not include on-chip valves. In some embodiments, although no on-chip valves are present for preventing diffusion of reagents not wanted for a reaction to be performed in the microfluidic reactor, diffusion of such reagents in the microfluidic reactor chamber can be limited using microfluidic flow of other reagents or washing buffer liquids.

In some embodiments, a microfluidic system is provided allowing microfluidic reactions in a reliable way.

The above is obtained by a system according to example embodiments.

The present disclosure relates to a microfluidic device comprising a reaction chamber allowing reacting of at least one fluid material, e.g. with another reactant either coating or bound to the surface of the reaction chamber or coating or bound to something placed into the reaction chamber, which includes but is not limited to beads or particles, and at least two fluidic channels coupled to the reaction chamber for providing and exiting a fluid in respectively from the reaction chamber, each fluidic channel comprising an inlet and an outlet, wherein each fluidic channel is configured such that when a fluid is provided in the reaction chamber via that fluidic channel, the fluid exits the reaction chamber via the outlet of at least one other fluidic channel when the reactor is filled, thereby preventing a fluid from the at least one other fluidic channel, when present in the inlet, from diffusing into the reaction chamber. In some embodiments, load and unload of reagents can be performed quickly, and back diffusion of fluids from the inlet ports to the cavity is reduced or even avoided, with no need of valves integrated in the fluidic chip.

The microfluidic device may comprise a wash buffer channel for flushing the reaction chamber. In some embodiments, a buffer may be used for removing remaining fluids from the cavity and ports.

Each fluidic channel may be configured such that when a wash buffer is provided in the reactor via the wash buffer channel, the wash buffer exits the reactor via the outlet of each fluidic channel when the reactor is filled thereby preventing a fluid, when present in the inlet, from diffusing into the reaction chamber.

In some embodiments, by proper design and positioning of the outlet ports and input ports, a high purity of the reagent can be maintained.

The inlets and the outlets of the at least two fluidic channel may have a fluidic resistance to limit diffusion of unwanted reagents into the micro reactor.

The cavity formed by the reaction chamber may have a corner-free shape. The cavity formed by the reaction chamber may have a rounded shape. In some embodiments, less traces of liquid may remain in corners of the cavity.

Each of the inlet ports may have a same shape, geometry and/or fluidic resistance and/or each of the outlet ports have a same shape, geometry and/or fluidic resistance.

The microfluidic device may comprise a controller for controlling the supply of fluids in the reaction chamber through one or more first fluidic channels of a plurality of fluidic channels such that supply of a liquid to the reaction chamber through the one or more first fluidic channels is performed whereby the fluid exits the reaction chamber via the outlet(s) of the other fluidic channel(s) of the plurality of fluidic channels, thereby preventing fluids from the other fluidic channel(s) of the plurality of fluidic channels from diffusing into the reaction chamber. The controller may be programmed for, during the target reaction, continuously maintaining a flow of reagent(s) that should interact, thus introducing a continuous volume of flow in the reaction chamber and an equal continuous volume of flow out of the reaction chamber. The controller may be programmed for providing the continuous flow of reagent entering through inlets from the one or more first fluid channels and for providing the continuous flow out of the reaction chamber through outlets in microfluidic channels of reagents not wanted in the target reaction.

The present disclosure also relates to a microfluidic system comprising a plurality of microfluidic devices as described above, the plurality of fluidic reaction chambers being positioned in an array. In some embodiments, parallel reactions can be obtained, increasing throughput or yield. In some embodiments, fewer components can be used to control flow in a microfluidic system using microfluidic devices in parallel, thus simplifying the system and saving costs.

The microfluidic system may be a diagnostic system.

The microfluidic system may comprise at least one microfluidic device comprising five reagent inlets, e.g. for performing DNA sequencing.

The present disclosure also relates to a method for creating a reaction in a microfluidic reaction chamber, the method comprising, during the target reaction, continuously maintaining a flow of reagent(s) that should interact, thus introducing a continuous volume of flow in the reaction chamber and an equal continuous volume of flow out of the reaction chamber, wherein the continuous flow out of the reaction chamber occurs through outlets in microfluidic channels of reagents not wanted in the target reaction, thus preventing reagents not wanted in the target reaction and spontaneously diffusing towards the reaction chamber from entering the reaction chamber by sweeping them into the outlet by the continuous flow out of the reaction chamber through the outlets.

The method may be a diagnostic method.

The target reaction may be part of a DNA sequencing step.

Particular aspects are set out in the accompanying independent and dependent claims. Features from the dependent claims may be combined with features of the independent claims and with features of other dependent claims as appropriate and not merely as explicitly set out in the claims.

These and other aspects of the disclosure will be apparent from and elucidated with reference to the embodiment(s) described hereinafter.

BRIEF DESCRIPTION OF THE DRAWINGS

FIG. 7C illustrates a predetermined procedure, according to example embodiments.

Figure 1:
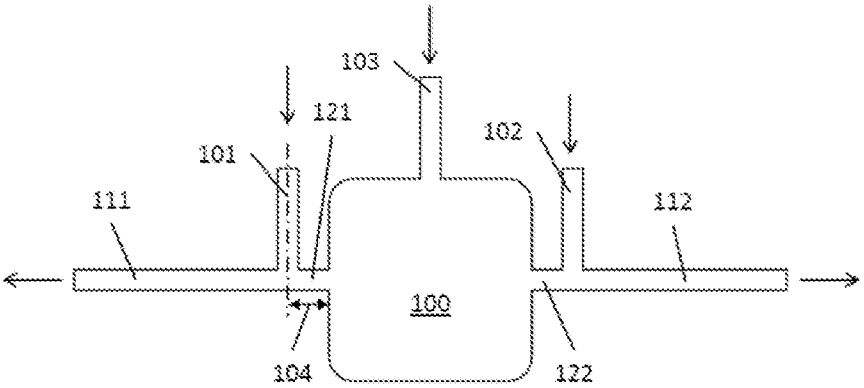
FIG. 1 illustrates a schematic representation of a reaction chamber, according to example embodiments.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION

The present disclosure will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the only relevant components of the device are A and B.

Reference throughout this specification to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of example embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments may be practiced without these specific details. In other instances, conventional methods, structures and techniques have not been shown in detail in order not to obscure an understanding of this description.

In a first aspect, the present disclosure relates to a microfluidic device with a reaction chamber and an arrangement of channels for introducing in and removing multiple fluids from the reaction chamber, which may reduce or avoid cross-contamination. The microfluidic device may be used in applications where a plurality of reagents is introduced sequentially in the reaction chamber, and where contamination of a reagent not used in the targeted reaction should be avoided. At least two fluid channels are connected to the reaction chamber for introducing fluids therein. Each of the fluidic channels comprises an inlet and an outlet.

According to embodiments, each fluidic channel is configured such that when a fluid is provided in the reaction chamber via that fluidic channel, the fluid exits the reaction chamber via the outlet of at least one other fluidic channel when the reactor is filled, thereby preventing a fluid from the at least one other fluidic channel, when present in the inlet, from diffusing into the reaction chamber. In operation, the system thus operates under continuous flow of the reagents used in the targeted reaction. This continuous flow avoids that reagents not involved in the targeted reaction, but present in the microfluidic channels, diffuse into the reaction chamber.

In some reactions targeted, two different reagents may be introduced in the reaction chamber, whereby further reagents are prevented from diffusing into the reaction chamber due to the continuous feeding of the two different reagents and the fact that the continuous feeding is removed from the reaction chamber, using the outlets in the microfluidic channels of the reagents not used in the targeted reaction. This reduces back-diffusion and increases the purity of the fluids within the chamber, improving the quality of the reactions. This implementation obtains high levels of purity without the need of pumps or valves at each individual inlet and/or outlet port, which may be employed when implementing a plurality of micro reactors. The removal of previous reagents can be performed fast in a simpler system, increasing the overall speed of sample loading and waste removal.

Via the outlets, the fluid can be brought outside the microfluidic device, e.g. towards a collector for disposal, to a different part of a microfluidic system, etc. The inlets allow for the provision of reagents or fluids from a reagent channel or reservoir to the reactor cavity.

In some embodiments, the inlets and the outlets are configured with a fluidic resistance to limit diffusion of unwanted reagents into the microreactor. The range of resistances of the inlet and outlet may be within $10^{16}$ to $10^{22}$ Pa*s/$m^3$. The fluid resistance of the ports may be configured by choosing appropriate dimensions, such as appropriate length of the port microchannels, or appropriate width or diameter, or a combination thereof. However, the present disclosure is not limited to microchannels. Other fluidic connections can be used. For example, a sink may be included in each inlet port microchannel, the sinks having a shape and size such that yields a predetermined fluidic resistance.

By way of illustration, embodiments not being limited thereto, a number of standard and optional features will be discussed with reference to example microfluidic devices. FIG. 1 shows an example microfluidic device comprising a reaction chamber 100 and two microfluidic inlet channels 101, 102 and two microfluidic outlet channels 111, 112. The reaction chamber 100 may have any suitable shape, for example square, circular, ellipsoidal, etc. In some embodiments, corners are avoided in the reaction chamber, as this eases washing of the reaction chamber. The reaction chamber may include a sensor or multiple sensors for detecting or monitoring the reaction. Alternatively, the sensor may be external to the reactor, using optical detection for example. An optional wash port 103, for example for introducing and/or removing wash buffer, is included. The microfluidic inlet channels 101, 102 and outlet channels 111, 112 are connected to microfluidic channels 121, 122. Microfluidic channels 121, 122 are then connected to the reaction chamber 100. The inlet channels may be positioned at a predetermined distance 104 from the reaction chamber and under a predetermined angle, e.g. forming a 90° angle, but other angles are possible. This predetermined distance 104 between the inlet channel and the reaction chamber provides a determined flow resistance in series between the outlet/inlet channels and the reaction chamber (the flow resistance being also determined by the sizes and cross-sections of the channels). For example, the distance 104 between the cavity and the outlet may be such that the flow resistance of the microfluidic channel 121 is below approximately 100% of the resistance of inlet channel 101 or outlet channel 111. Maximizing the resistance of channel 121 improves the purity of the reagent that can be introduced into the reaction chamber 100 through inlet channel 101. However, minimizing this resistance results in less wastage of the reagent introduced into inlet channel 101 through outlet channel 111, thereby bypassing the reaction chamber 100. The distance 104 should therefore be chosen to balance these two competing interests, with the optimal distance depending on the specifics of the design (reactor volume, flow rates, etc.).

In embodiments, each of the inlet ports has the same shape, geometry, and fluidic resistance, and each of the outlet ports has also the same shape, geometry, and fluidic resistance. In alternative embodiments, each of the inlet ports and outlet ports are tailored for specific fluids and reagents to be used with the ports.

Figure 2A:
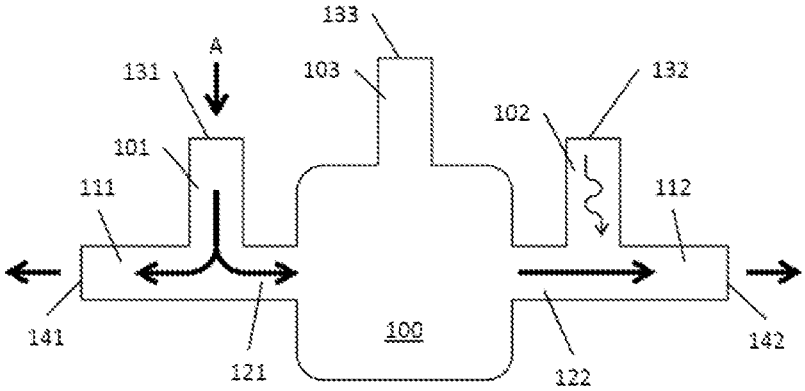
FIG. 2A illustrates the operational principles according to example embodiments.
Figure 2B:
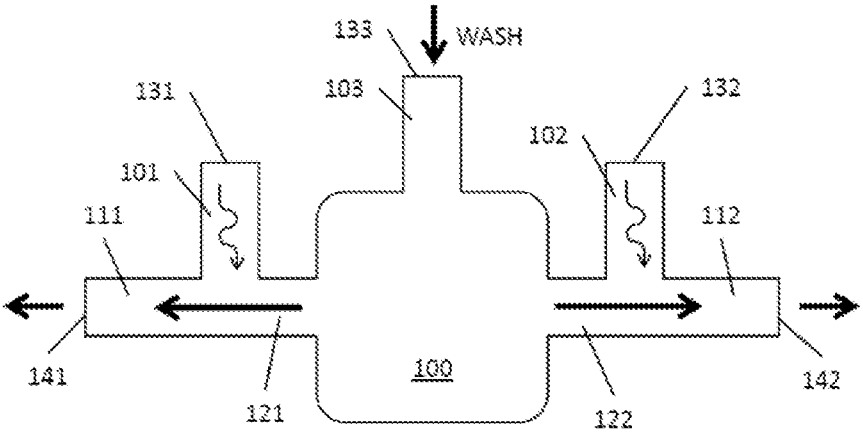
FIG. 2B illustrates the operational principles according to example embodiments.
Figure 2C:
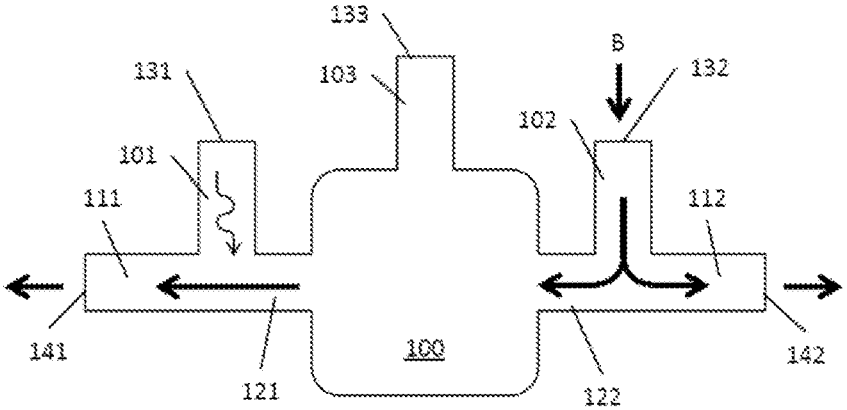
FIG. 2C illustrates the operational principles according to example embodiments.

FIGS. 2A-2C illustrate the operational principles of embodiments. In practice, inlet channels 101, 102, 103 are each connected to separate supply channels through the respective inlet ports 131, 132, 133. Each supply channel is connected to a respective reservoir, each containing a separate fluid. The supply channels have relatively low resistance compared to inlet channels 101, 102, 103. The purpose of channels 101, 102, 103 are to limit diffusion from the supply channel into the reaction chamber. The inlet channels 101, 102, 103 may have small cross-sectional dimensions and relatively long lengths to limit diffusion. However, such channels result in large pressure drops so a balance should be made between maintaining acceptable pressure drops while limiting mass diffusion rates. Valves can be placed between the supply channels and the reservoirs to control when each fluid is introduced into the reaction chamber 100. Outlet channels 111, 112 can be connected to a common outlet supply channel through outlet ports 141, 142. The outlet supply channel leads either to further processing and/or analysis or to waste.

FIG. 2A shows the introduction of reagent fluid A through inlet port 131 into inlet channel 101. Valves stop the reagent fluid B and wash buffer from entering through inlet ports 132, 133, respectively, into inlet channels 102, 103, respectively. However, by mass diffusion, reagent B still enters into inlet channel 102. Mass diffusion of reagent B into the reaction chamber 100 may be mitigated by advection of reagent B using the flow stream of reagent fluid A through channel 122, thereby sweeping the diffusing reagent B into the outlet channel 112. A high purity of reagent fluid A is thus maintained in the reaction chamber 100.

FIG. 2B shows the flow of wash buffer into the reaction chamber 100. The purpose of the wash buffer is to remove the previously introduced reagent fluid from the reaction chamber 100 before the introduction of the next reagent fluid. The wash buffer is introduced into inlet channel 103 through inlet port 133. Valves prevent the flow of reagent fluids A, B into inlet channels 101, 102, respectively. However, as noted earlier, mass diffusion leads to reagents A, B being transported through inlet channels 101, 102, respectively. The wash buffer flows through channels 121, 122 carrying away the reagents A, B, respectively, into the outlet channels 111, 121, respectively. Both reagent fluids A, B are effectively removed from the reaction chamber 100 by flowing the wash buffer.

FIG. 2C shows the introduction of reagent fluid B. In a process similar to the earlier discussion, reagent A diffusing through inlet channel 101 is carried away by reagent fluid B flow from channel 121 into the outlet channel 111 maintaining a high purity of reagent B in the reaction chamber 100.

After introduction of reagent fluid B into the reaction chamber, reagent fluid B can be removed from the reaction chamber by introducing another wash step as shown in FIG. 2B. If a cyclical reaction is desired, reagent fluid A can then be introduced again as shown in FIG. 2A and the process can repeat. During each stage, a high purity of the chosen reagent is maintained in the reaction chamber. Therefore, if a reaction occurs between the chosen reagent and molecules bound either to the surface of the reaction chamber or to beads/particles placed inside the reaction chamber, then it can be determined with high probability which reagent reacted.

Figure 3:
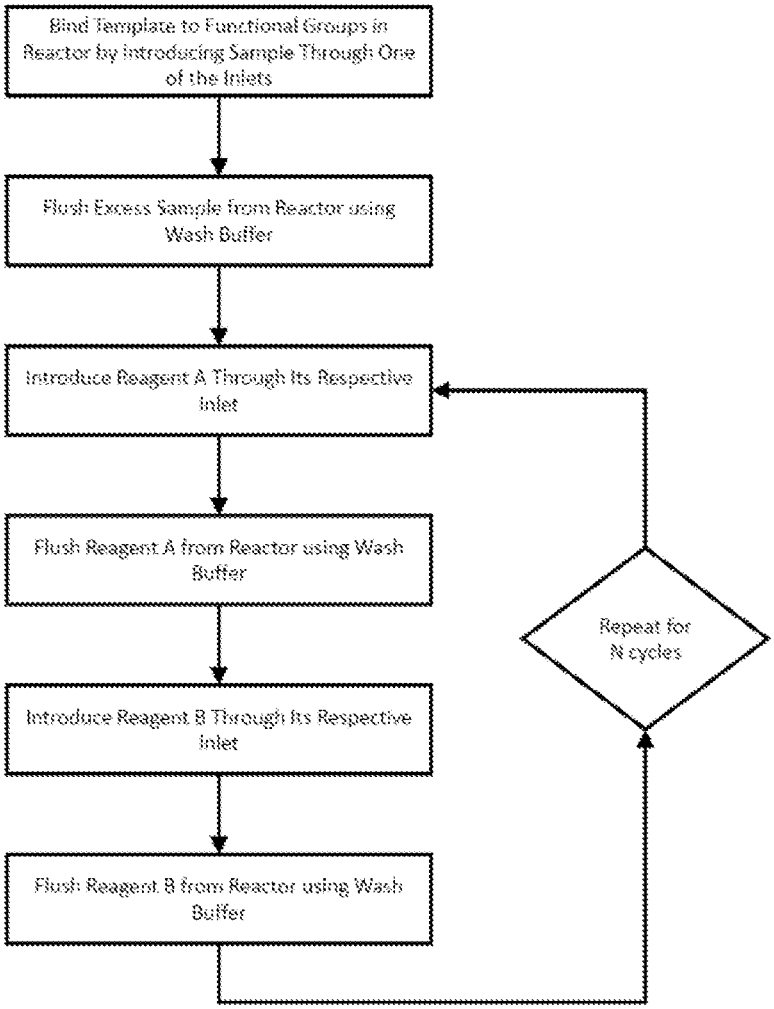
FIG. 3 illustrates an outline of how the microfluidic reactor can be utilized for synthesis, according to example embodiments.

FIG. 3 shows an outline of how the microfluidic reactor can be utilized for synthesis (of organic molecules such as DNA, for instance). First, the template for synthesis (single stranded DNA in the case of sequencing applications) is bound to functional groups in the microreactor or beads in the microreactor. The excess template is then washed from the reactor using the wash buffer. The first reagent A is flushed through the microreactor. For DNA sequencing, reagent A may contain one of the nucleotides, which is incorporated into the single stranded DNA through the assistance of an enzyme called a polymerase if and only if the nucleotide in reagent A forms the correct base pair at the first open site of the single-stranded DNA molecule. Incorporation of the nucleotide results in the formation of pyrophosphate, which can be detected optically using an enzyme such as luciferase. If reagent A does not contain the correct nucleotide, incorporation does not occur and no pyrophosphate is produced. Reagent A can then be removed from the reactor using the wash buffer.

After the concentration of reagent A in the reactor is suitably low, the next reagent B can be introduced. A high purity of reagent B can be obtained upon introduction into the microreactor without the use of microfluidic valves. Additional reagents (for as many reagent lines are connected to the microreactor) can be introduced into the reactor at high purities by proceeding with a wash step. After introduction of all the reagents, the process can be repeated in a cyclical manner. For the application of DNA sequencing by synthesis, this allows for introduction of each of the nucleotides, one-by-one, into the reactor. Detection of an optical signal indicates incorporation of one of nucleotides into the single stranded DNA fragment. Since the nucleotides are introduced into the reactor at high purity, it can be determined with some confidence which nucleotide was incorporated.

Figure 4A:
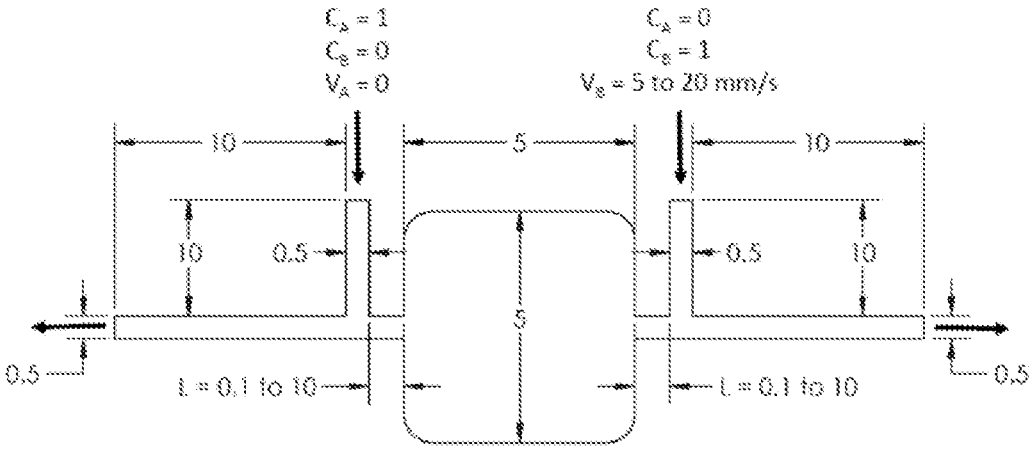
FIG. 4A illustrates a microfluidic device and its performance characteristics, according to example embodiments.
Figure 4B:
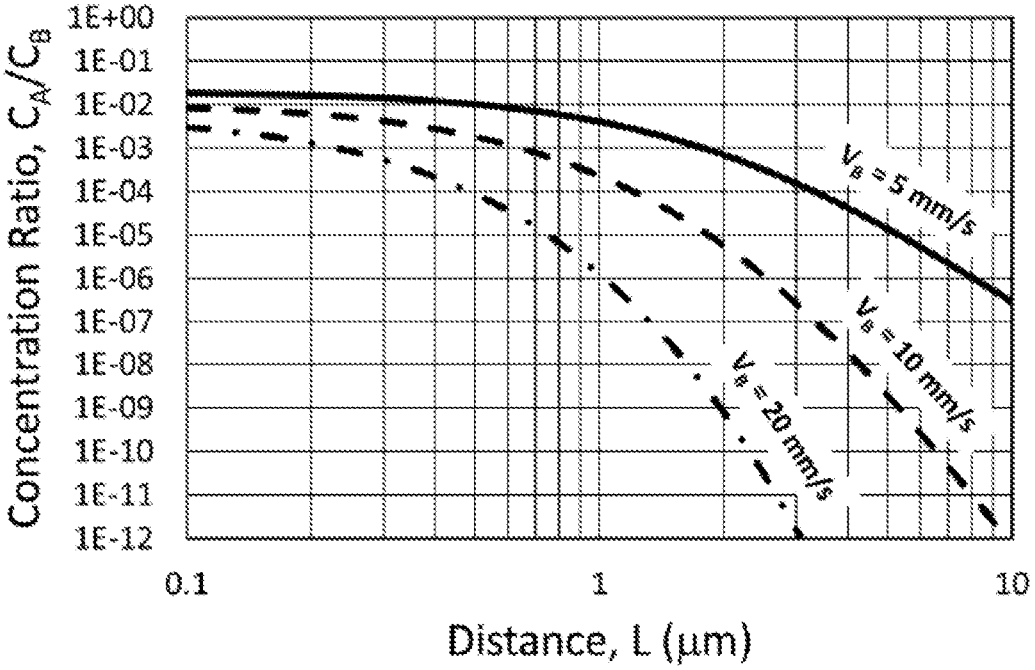
FIG. 4B illustrates a microfluidic device and its performance characteristics, according to example embodiments.

FIG. 4A and FIG. 4B show an example of the embodiment in FIG. 1 and the performance characteristics of such an example. The dimensions of the example reactor are given in FIG. 4A, all dimensions being in micrometer and the depth of the reactor and connecting channels being constant at 0.5 μm. It is to be noticed that the dimensions illustrate one particular example, embodiments not being limited thereto. The 1-dimensional, steady-state, advection-diffusion problem is solved to yield approximate performance characteristics of the example reactor. The model simulates the scenario where reagent B is being pumped (at $V_B$=5, 10, or 20 mm/s) into the reactor while reagent A only diffuses into the reaction chamber. The length of channel 121, 122 is varied from L=0.1 μm to 10 μm. The fluid is assumed to have a viscosity of 1 mPa·s and the diffusion coefficient of both reagent species are assumed to be $10^{-9}$ $m^2/s$. The modeling results (see FIG. 4B) show that under steady-state conditions, purities on the order of parts per million (ppm) or better are readily achievable. Higher inlet velocities VB and larger lengths L yield higher purity levels in the reactor.

Figure 5A:
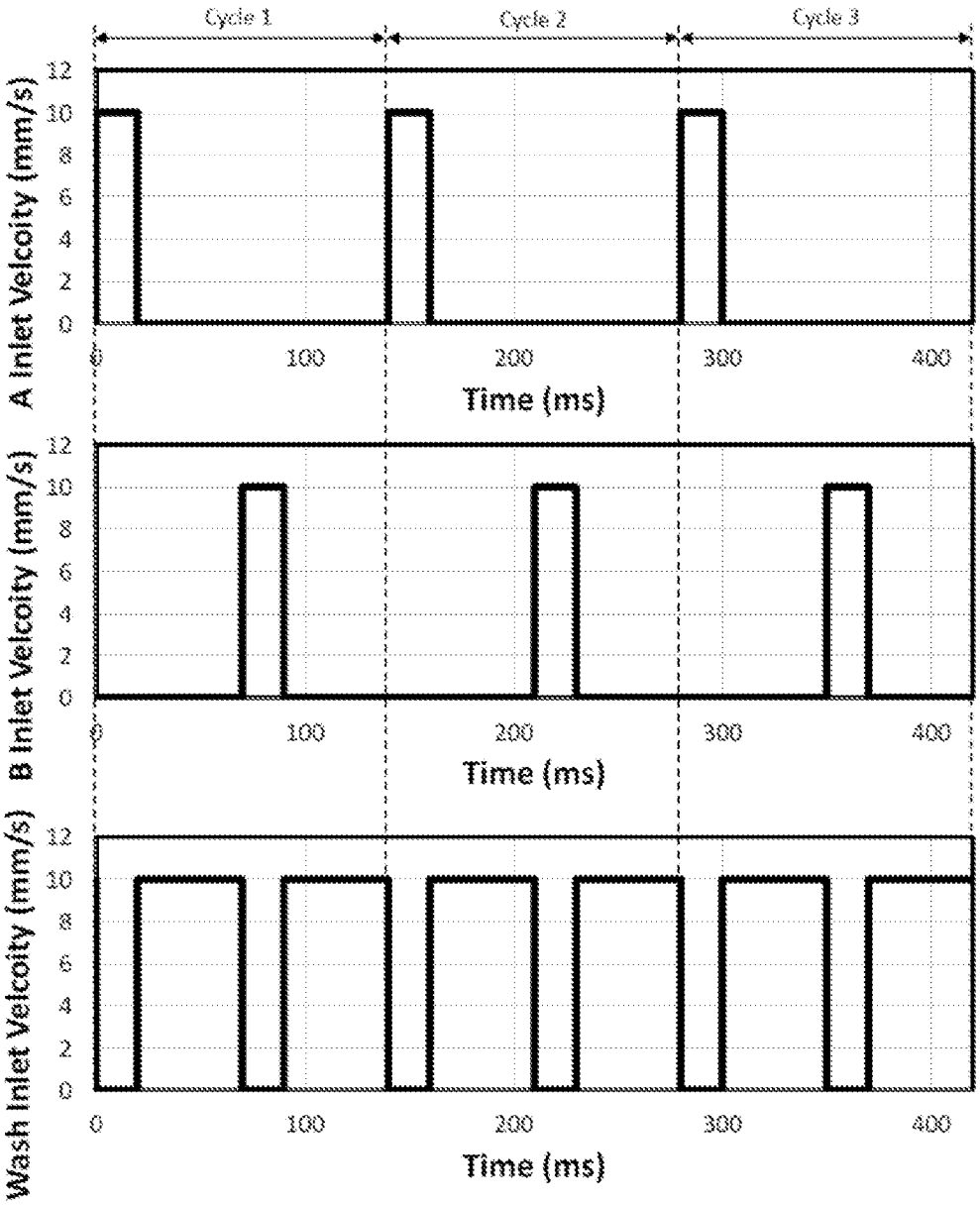
FIG. 5A shows the average fluid velocities at the inlets of a two reagent reactor and the resulting time-dependent concentrations, according to example embodiments.
Figure 5B:
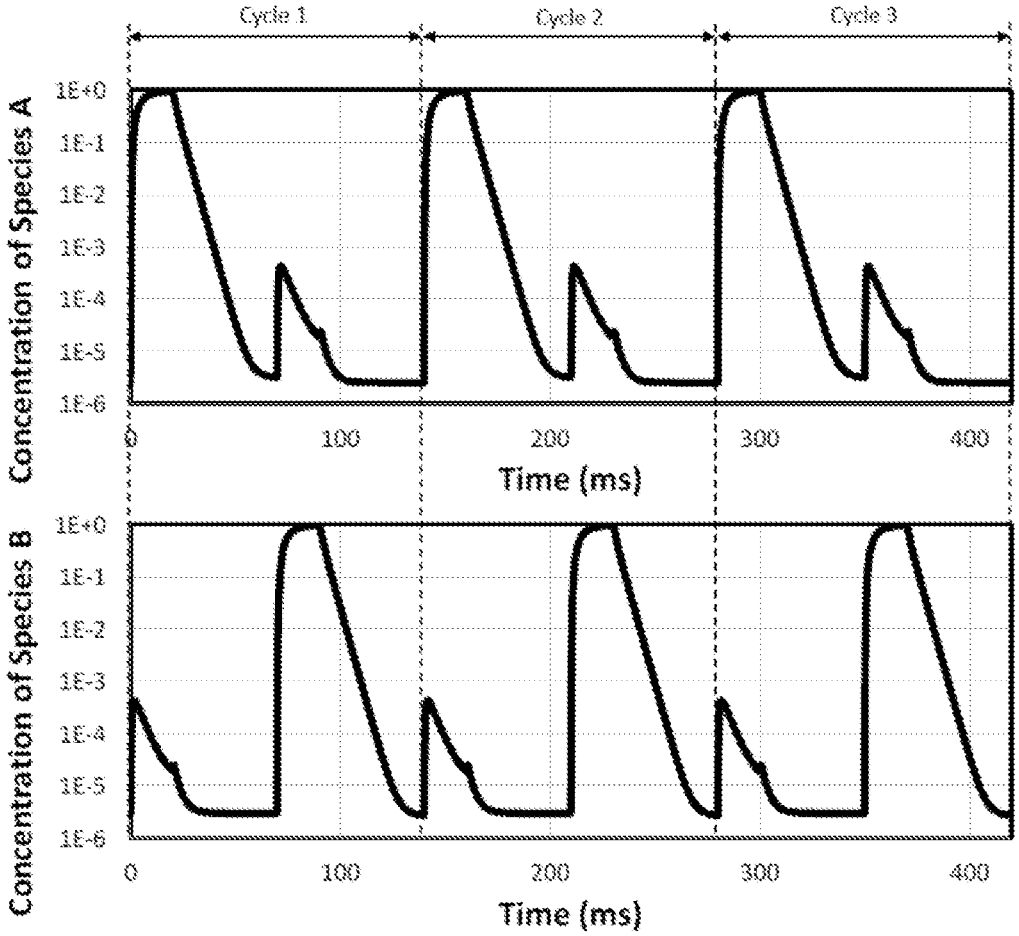
FIG. 5B shows the average fluid velocities at the inlets of a two reagent reactor and the resulting time-dependent concentrations, according to example embodiments.

FIG. 5 shows the average fluid velocities at the inlets of a two reagent reactor with a separate wash inlet and the resulting time-dependent concentrations of the two chemical species being introduced in the reactor. During cycle 1, reagent A is introduced, followed by a wash cycle, followed by reagent B introduction, and followed by a wash cycle (see FIG. 5A). The sequence is repeated for cycles 2 & 3. The normalized concentrations of species A and species B, the chemicals of interest in reagents A and B, respectively, are shown in FIG. 5B. In cycle 1, the normalized concentration of species A quickly approaches 1 during the introduction of reagent A. During the wash step, the concentration of A gradually decreases to a very low value. During introduction of species B, the concentration of A does increase in the reactor to a value of about $4\times10^{-4}$, which is more than a 1000 times lower than the concentration of species B in the microreactor.

Figure 6:
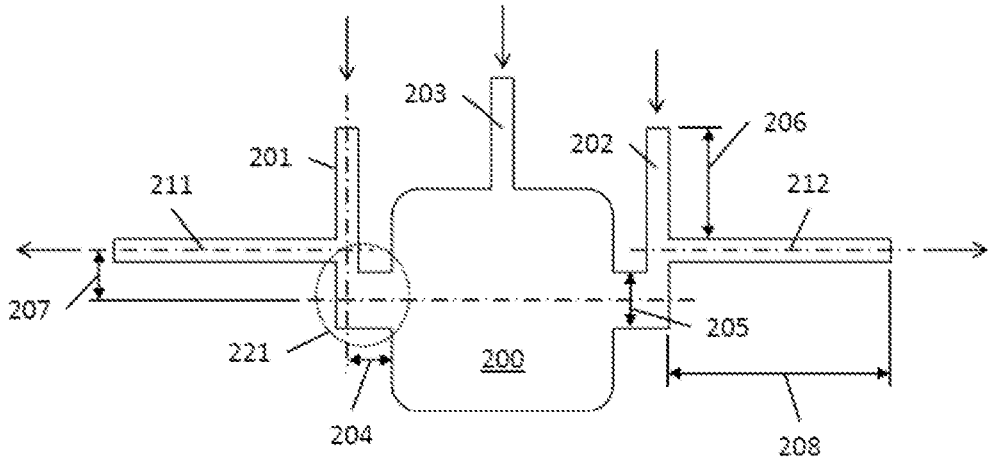
FIG. 6 shows a microfluidic device, according to example embodiments.

FIG. 6 shows another embodiment. Channel 221 has an enlarged cross-section, as indicated by dimension 205, to reduce the flow resistance in series between the inlet/outlet channel 201, 211 and the reaction chamber 200. Channel 221 in FIG. 3 is drawn with a constant width but this does not preclude the use of a tapered, rounded, or other suitable shape. The reduced resistance of channel 221 reduces the wastage of the reagent introduced through inlet channel 201 and flowing out of outlet channel 211. In other words, the reduced resistance of channel 221 allows a larger proportion of the reagent fluid introduced into inlet channel 201 to flow into the reaction chamber 200. Outlet channel 211 may be offset by dimension 207, which further reduces unwanted mass diffusion into the reaction chamber at the cost of increased wastage of reagents.

Figure 7A:
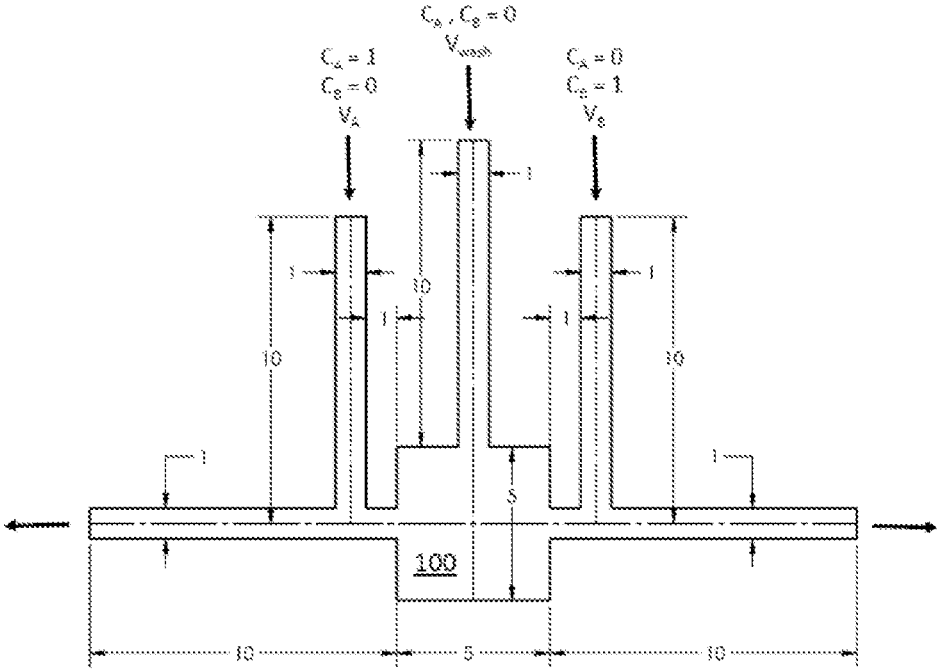
FIG. 7A illustrates a reactor, according to example embodiments.
Figure 7B:
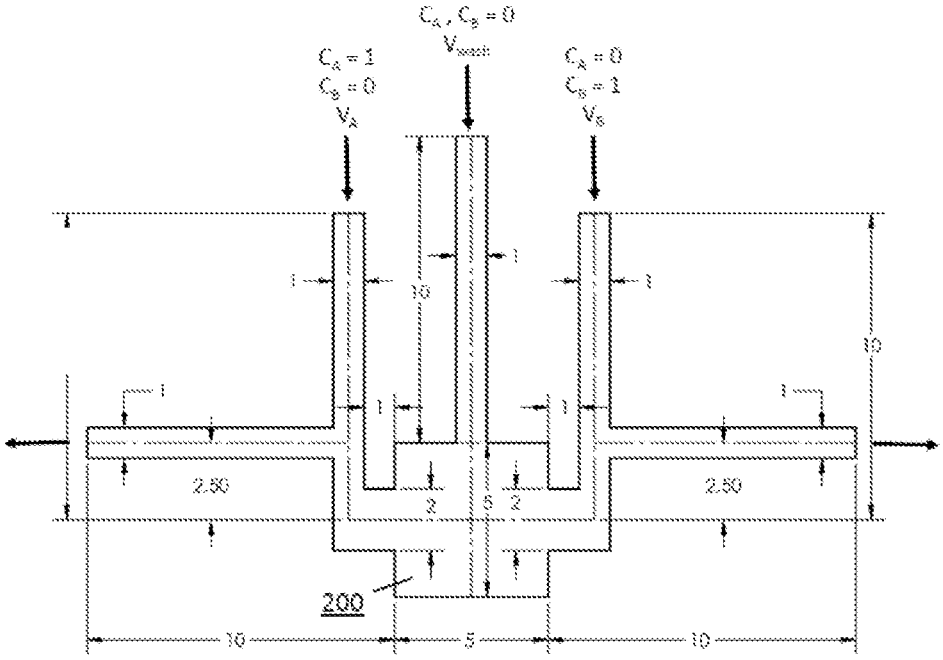
FIG. 7B illustrates a reactor, according to example embodiments.

FIGS. 7A-7E compare the performance of a reactor of embodiment 100 (see FIG. 7A) to a reactor of embodiment 200 (see FIG. 7B). The dimensions shown in FIGS. 7A and 7B are all in micrometer. It is to be noted that the dimensions shown are examples and that embodiments are not limited thereto. Transient 2D simulations (assuming infinite depth) are conducted to assess the performance, which should provide reasonably accurate results for species concentration. The simulation procedure is outlined in FIG. 7C. First, the numerical domain is initialized by solving the steady-state problem where the mean velocity at the wash inlet is $V_{wash}$=10 mm/s and the other inlets are set to 0. This is representative of the flow and species concentration in the reactor after a long wash step. To simulate the step representing the introduction of species B into the microreactor, first the fluid flow (pressure and velocities) for an inlet velocity of $V_B$=10 mm/s is solved while the species concentration is not updated. This can be done because the fluid flow variables reach steady-state conditions in a microsecond time scale while for species concentration, the time scale of interest is in milliseconds. Finally, the transient species concentration is solved for each numerical case.

Figure 7D:
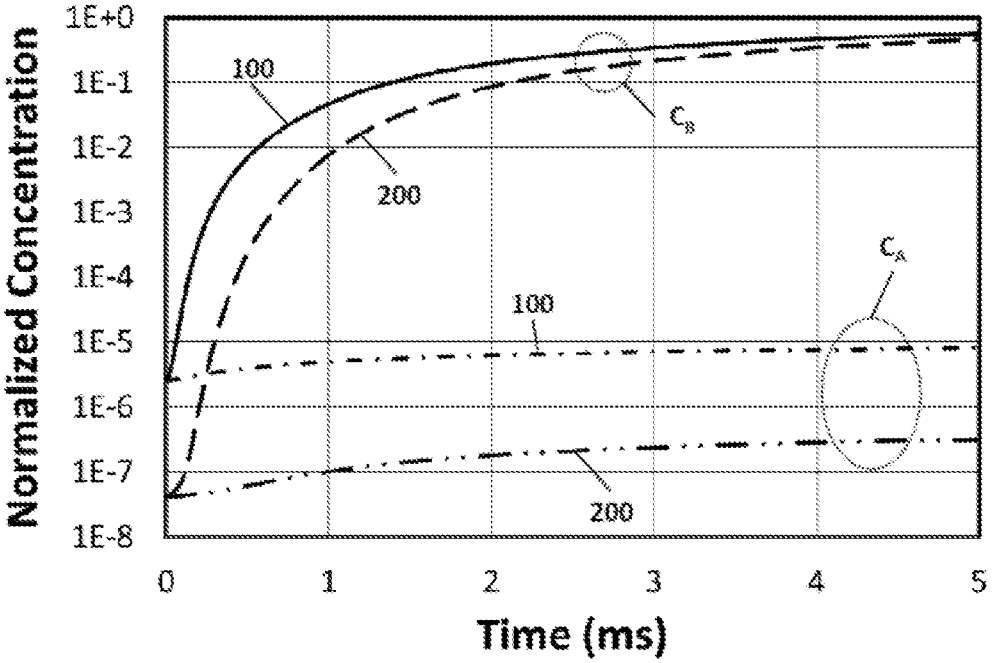
FIG. 7D illustrates a transient 2D simulation obtained using the predetermined procedure of FIG. 7C, according to example embodiments.
Figure 7E:
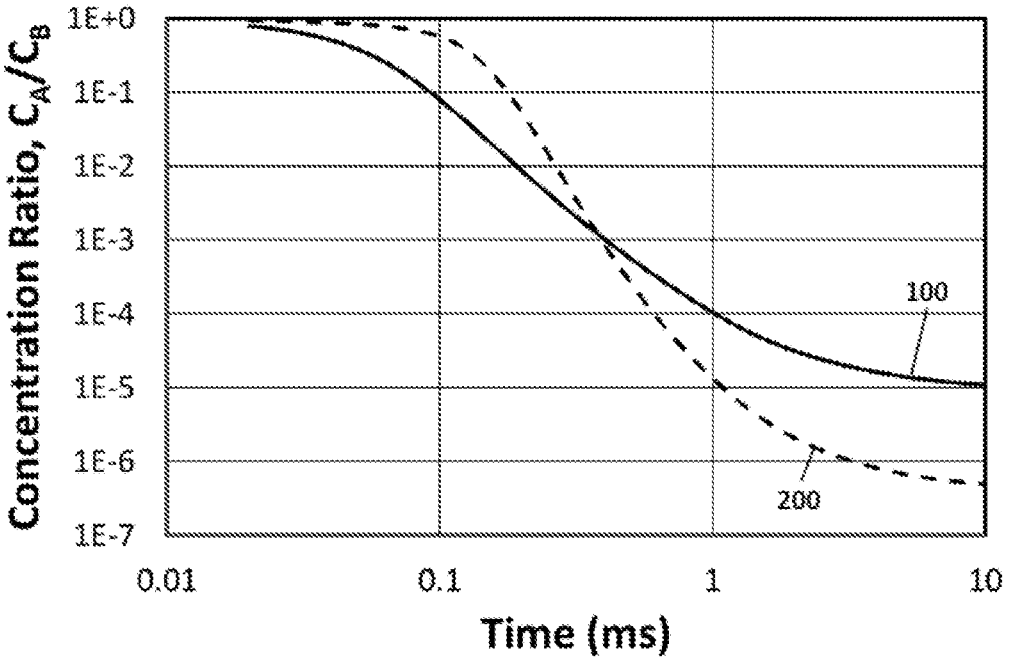
FIG. 7E illustrates a transient 2D simulation obtained using the predetermined procedure of FIG. 7C, according to example embodiments.

The results of the analysis are shown in FIGS. 7D and 7E. The normalized concentration of species B reaches nearly unity within a few milliseconds (see FIG. 7D) for both embodiments 100 and 200 while the normalized concentration of species A remains low throughout the introduction of species B into the reactor. The concentration ratio, CA/CB, reaches approximately $10^{-5}$ for embodiment 100 (see FIG. 7E) at 10 ms. For embodiment 200, the concentration ratio is over a magnitude lower at 10 ms, a considerable improvement.

For DNA sequencing applications, a total of 5 reagent inlets (1 for the wash buffer and 4 for each nucleotide: guanine, thymine, adenine, and cytosine) may be the most interesting.

Figure 8:
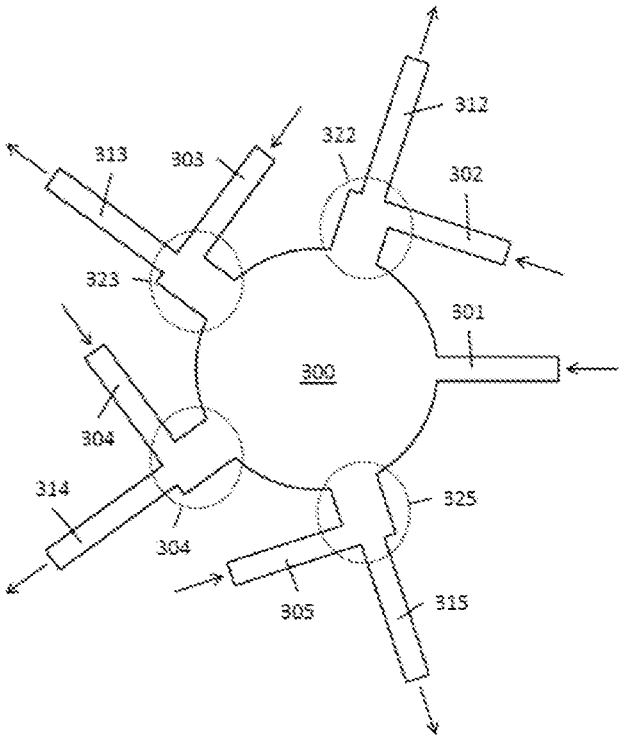
FIG. 8 shows a reaction chamber with a circular cavity, according to example embodiments.

FIG. 8 shows a reaction chamber comprising a circular cavity 300 and part of four inlet ports 302, 303, 304, 305 and a separate inlet for the wash buffer 301 with four outlet ports 312, 313, 314, 315 branching out of each inlet port. High degree of purity is obtained with the use of a minimal number of valves (total of 5 used for the configuration shown in FIG. 8; 1 for the wash and 4 for the reagents), which can be external to the microfluidic system. Design features discussed in previous embodiments, such as a channel with enlarged cross-section 322, 323, 324, 325, may also be present.

Figure 9:
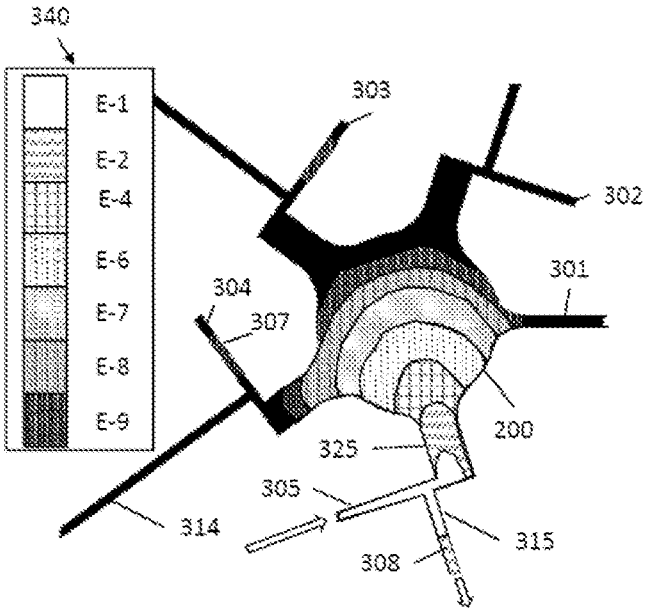
FIG. 9 shows a simulation of flow in a reaction chamber, according to example embodiments.

FIG. 9 shows an example of simulation of flow in a reaction chamber according to embodiments. The reactor comprises a circular cavity 300 with four inlet ports 302, 303, 304, 305 and a wash buffer inlet 301 and branching outlet ports 311, 312 at a predetermined distance of the cavity (or in this case, the nozzle 325, included in the cavity).

For example, reagents and/or buffer may be removed via the outlet ports. FIG. 9 shows the species concentration of a chemical being introduced via inlet 302, represented by patterned zones according to the normalized scale 340. Due to the higher flow resistance of the outlet port, most of the fluid enters the cavity, and much less amount of fluid passes to the outlet ports during filling. The amount of reagent 307 remaining in the inlet port channel 304 is reduced, because most of it is removed during filling (e.g. filling of cavity by other reagent) or wash (e.g. filling the cavity with buffer from the wash port 301) through the outlet port 314 connected to each inlet port 304. No valves or pumps are needed in the ports for preventing fluid back-diffusion from the inlet ports, as they are sufficiently cleared out by the included outlets.

Reactors according to embodiments can be used in a microfluidic system suitable for mixing two or more fluids, each fluid (e.g. reagent) being provided by a separate channel. Each channel may pump fluids into the reactors, for which integrated or external valves can be used. Embodiments allow a high flexibility of design, because it can be connected to any channel of a fluidic system. The reactor may be included in a chip, and the problem of limiting diffusion is solved without the use of on-chip valves. The valves can be external to the reactor.

In a further aspect of the present disclosure, a fluidic system comprising a plurality of microfluidic devices can be obtained. This aspect can be applied to, for example, microfluidic systems. At least two fluidic channels can be connected to each of the at least two inlet ports of a plurality of reactors of the first aspect. Embodiments of the second aspect provide a plurality of reactors which can be used in parallel, increasing yield and saving time. In embodiments suitable for providing a given number N of reagents, being provided by N reagent channels, it is possible to use several reactors of the first aspect, for example M reactors (100), in parallel by an appropriate network of channels. Each of the reactors would comprise N inlet ports (102, 103). Some embodiments may use N valves (408—one valve per reagent channel), instead of N×M valves (one valve per inlet port). Even in embodiments comprising a wash port (103) in each reactor, only N+1 valves may be needed, N for the reagent channels, and one for a wash channel.

Figure 10:
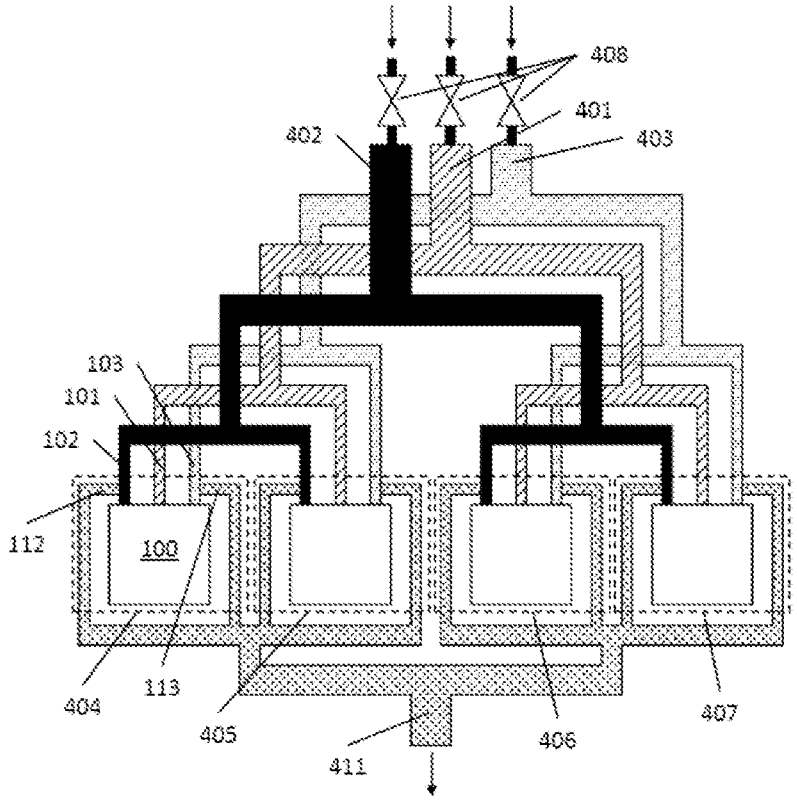
FIG. 10 illustrates four reactors connected to a hierarchical branched network of channels, according to example embodiments.

The example FIG. 10 shows four reactors (404, 405, 406, 407) connected to a hierarchical branched network of channels (401, 402, 403), which are connected to the external valves (408). Each reactor inlet is connected to an outlet channel (112, 113) to sweep away unwanted reagents diffusing into the reactors. The outlets are connected to a hierarchical network of channels 411. In practice, the number of reactors can thus be scaled to the millions while only using a relatively small number of external valves.

Additionally, a wash port can be added to each cavity, for flushing the cavities with washing liquid such as buffer, thereby improving further the purity, if necessary.

Figure 11A:
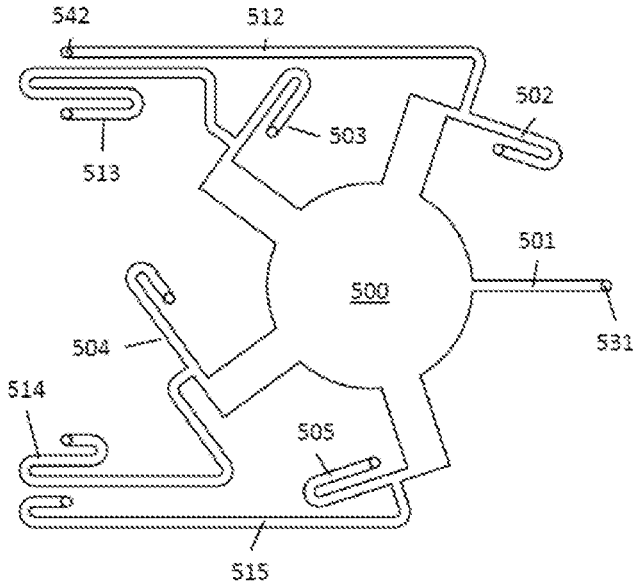
FIG. 11A illustrate a view of an implementation of a micro reactor design, according to example embodiments.
Figure 11B:
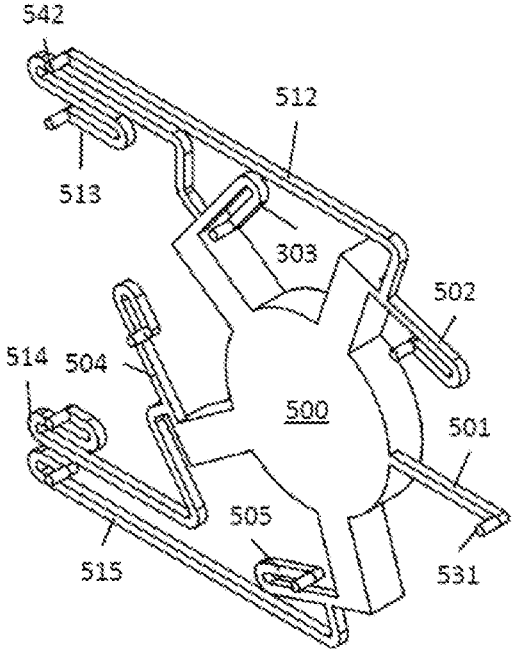
FIG. 11B illustrate a view of an implementation of a micro reactor design, according to example embodiments.

FIG. 11A and FIG. 11B shows two views of an implementation of a microreactor design. A microreactor 500 is connected to four reagent inlets 502, 503, 504, 505 and an optional wash inlet 501. The inlet channels 502, 503, 504, 505 and outlet channels 512, 513, 514, 515 may be serpentined to save footprint on the substrate. The inlet and outlet channels can be connected to supply channels for the reagents and the drain channels for the waste, respectively, via inlet ports 531 and outlet ports 542, respectively.

Figure 12A:
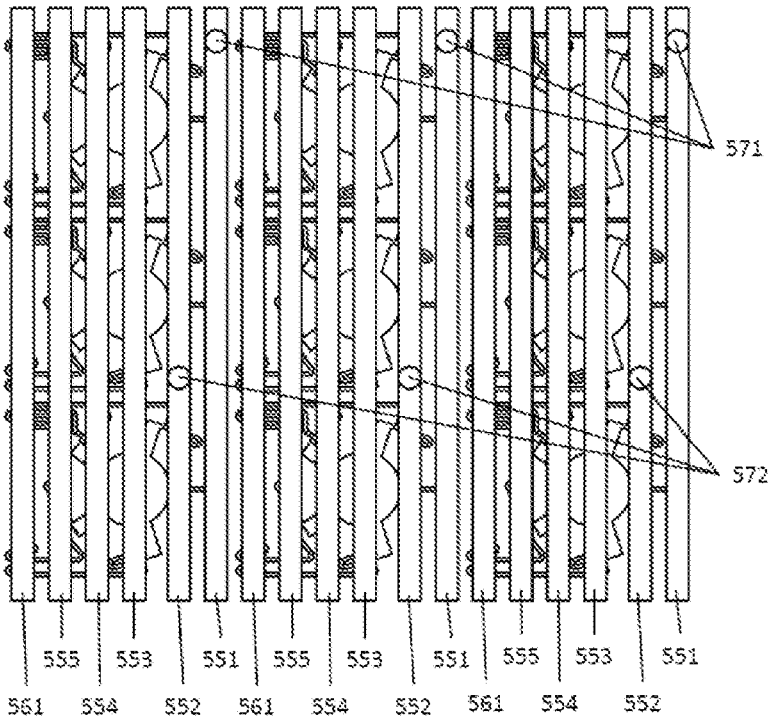
FIG. 12A shows two views of an array of micro reactors, according to example embodiments.
Figure 12B:
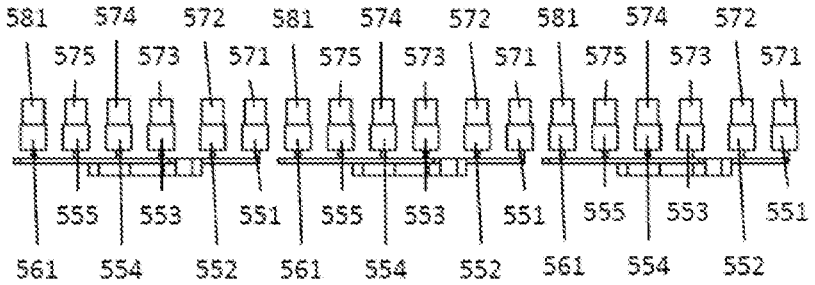
FIG. 12B shows two views of an array of micro reactors, according to example embodiments.

FIG. 12A and FIG. 12B shows different views of an array of micro reactors connected to supply channels 551 for the wash buffer, supply channels for the reagents 552, 553, 554, 555, and drain channels 561 for the waste outlets. The supply and drain channels are shown located on the top reactors so that a single supply/drain channel has fluidic access to multiple microreactors. Furthermore, another layer of supply and drain channels (not shown in FIG. 12A and FIG. 12B) can be located on top of the supply channels 551, 552, 553, 554, 555 and drain channels 561, fluidically connected to the underlying fluid network via ports 571, 572, 573, 574, 575, 581. This hierarchy can be repeated to access a large number of reactors with a minimal number supply and drain channels. For some applications, there may only be one supply channel per reagent. This arrangement only requires one valve per reagent, which can be external to the microfluidic system. A plurality of micro reactors can be connected to supply and drain channels and controlled via a minimal number of external valves.

Figure 13A:
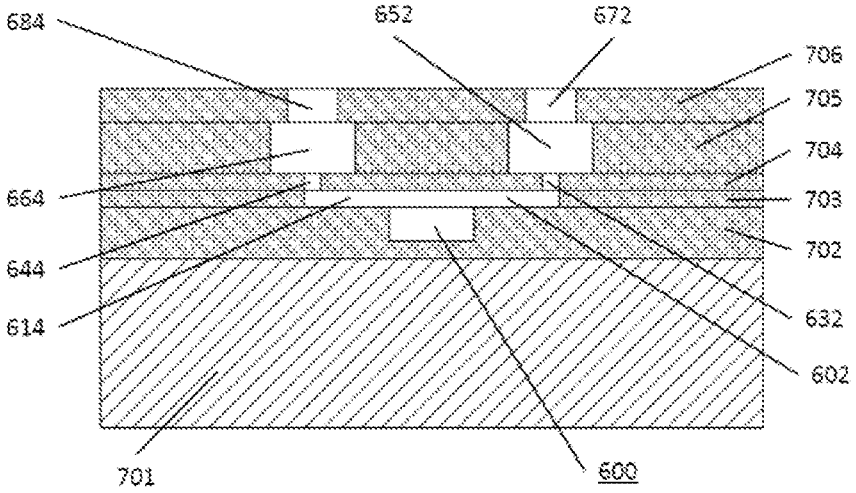
FIG. 13A illustrates a building of a structure using silicon micromachining, according to example embodiments.
Figure 13B:
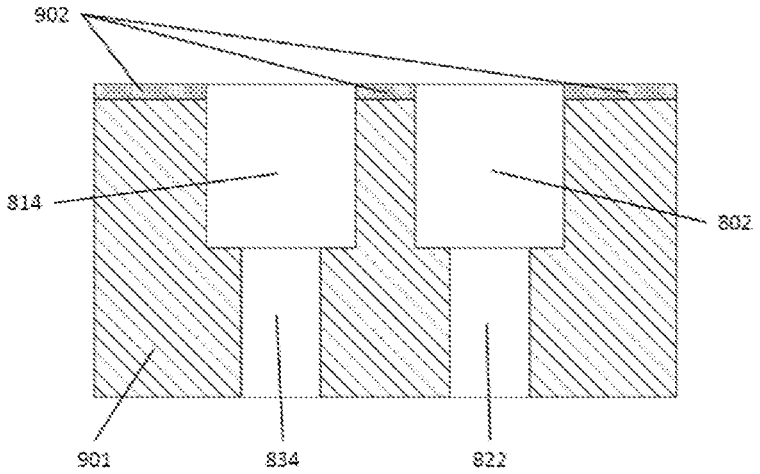
FIG. 13B illustrates a building of a structure using silicon micromachining, according to example embodiments.
Figure 13C:
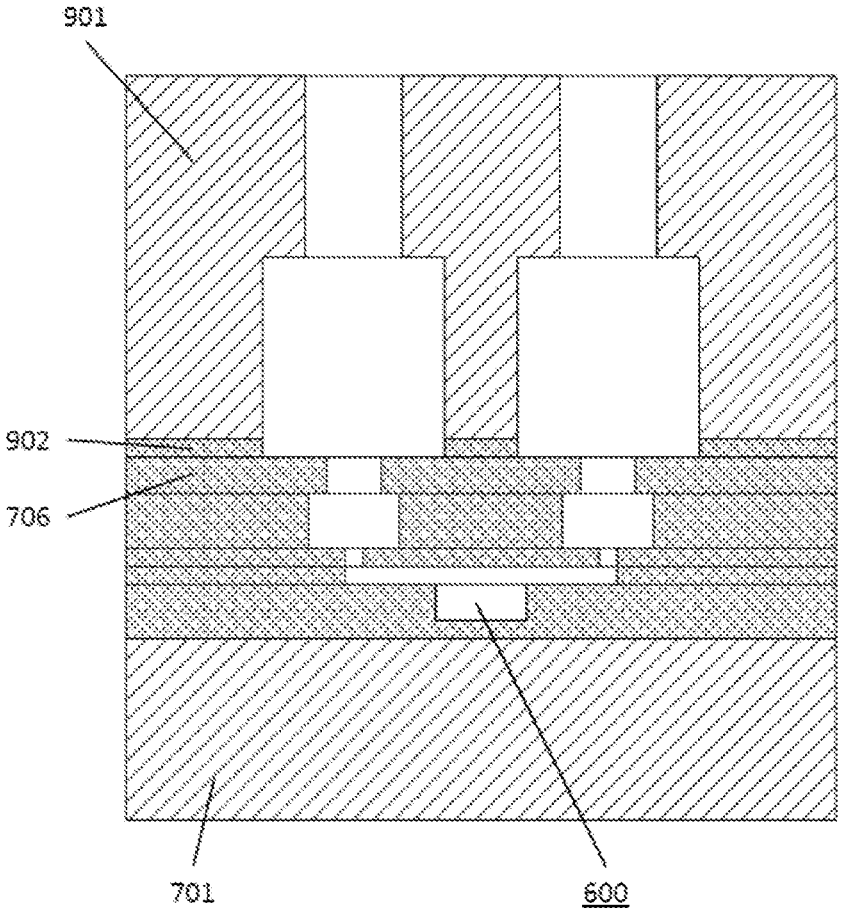
FIG. 13C illustrates a buildup of a structure using silicon micromachining, according to example embodiments.

Several methods of manufacturing may be employed to fabricate the microreactors, connecting channels, and supply and drain channels described herein. Among these, silicon and silicon dioxide micromachining may be the most amenable, especially when the size of inlet and outlet channels are in the hundreds of nanometers in width and depth. FIG. 13A, FIG. 13B, and FIG. 13C illustrate the buildup of the structure using silicon micromachining. An oxide layer 702 is thermally grown or deposited onto a silicon wafer. A micro reactor cavity 600 is etched into the oxide layer using isotropic or anisotropic etching. Another oxide layer 703 can be deposited onto layer 702 and etched to form the inlet 602 and outlet 614 connecting channels. Via ports 632 and 644 can be formed on another oxide layer 704, supply 652 and drain 664 channels can be formed on an oxide layer 705 and supply 672 and drain 684 ports formed in oxide layer 706 using a similar approach. For larger supply 802 and drain channels 814, deep reactive ion etching can be used in another silicon substrate 901 (see FIG. 13B). These supply and drain channels can be connected to inlet and outlet connections via ports 822, 834. A layer of oxide 902 can be thermally grown or deposited on the silicon substrate 901 to permit oxide-to-oxide bonding with the substrate shown in FIG. 13A.

The cross-section of the assembled microfluidic device is shown in FIG. 13C after oxide-to-oxide bonding via oxide layers 706 and 902. For applications of genomic sequencing, one of the substrate materials 701 or 901 may be optically transparent so that light produced in the microreactor 600 by the enzymatic reaction during incorporation of a nucleotide can be viewed by an external image sensor. Alternatively, substrate 701 can be an image sensor in silicon with pixels underneath the microreactor 600 to capture the light produced within the microreactor 600.

Some embodiments may be used for DNA sequencing, for example. Other uses may be production of oligonucleotides or isothermal polymerase chain reaction (PCR).

Although the present disclosure has been described with respect to microfluidics, it is not intended to limit the application to any particular size of its components; for example, it may be applied to nanofluidic systems.

In yet another aspect, the present disclosure relates to a method for creating a reaction in a microfluidic reaction chamber. The method comprises, during the target reaction, continuously maintaining a flow of reagent that should interact. This means introducing a continuous volume of flow in the reaction chamber and removing an equal continuous volume of flow out of the reaction chamber. According to the method, the continuous flow out of the reaction chamber occurs through outlets in microfluidic channels of reagents not wanted in the target reaction, thus preventing reagents not wanted in the target reaction and spontaneously diffusing towards the reaction chamber from entering the reaction chamber by sweeping them into the outlet by the continuous flow out of the reaction chamber through the outlets. Other method steps may express the functionality of particular components of the device as described in the first aspect.

What is claimed is:

1. A microfluidic device comprising:

a reaction chamber allowing reacting of at least one fluid material; and at least two fluidic channels coupled to the reaction chamber for providing a fluid to and exiting a fluid from, respectively, the reaction chamber, wherein each fluidic channel comprises an inlet and an outlet, and wherein each fluidic channel is configured such that when a first fluid is provided in the reaction chamber via that fluidic channel, the first fluid exits the reaction chamber via the outlet of at least one other fluidic channel when the reaction chamber is filled, thereby preventing a second fluid from the at least one other fluidic channel, when present in the inlet, from diffusing into the reaction chamber.

2. The microfluidic device according to claim 1, further comprising a wash-buffer channel for flushing the reaction chamber.

3. The microfluidic device according to claim 2, wherein each fluidic channel is configured such that when a wash buffer is provided in the reaction chamber via the wash-buffer channel, the wash buffer exits the reaction chamber via the outlet of each fluidic channel when the reaction chamber is filled, thereby preventing the first fluid and the second fluid, when present in the inlets of the at least two fluidic channels, from diffusing into the reaction chamber.

4. The microfluidic device according to claim 1, wherein the inlets and the outlets of the at least two fluidic channels have a fluidic resistance to limit diffusion of unwanted reagents into the reaction chamber.

5. The microfluidic device according to claim 1, wherein a cavity formed by the reaction chamber has a corner-free shape.

6. The microfluidic device according to claim 1, wherein each of the inlets has a same shape, geometry, or fluidic resistance.

7. The microfluidic device according to claim 1, wherein the reaction chamber and at least part of the fluidic channels are implemented on chip, wherein the microfluidic device further comprises valves for controlling a flow of reagents in the fluidic channels, and wherein the valves are positioned off chip.

8. The microfluidic device according to claim 1, further comprising a controller for controlling a supply of fluids in the reaction chamber through one or more fluidic channels of a plurality of fluidic channels such that fluid supplied to the reaction chamber via a first set of fluidic channels exits the reaction chamber via the outlets of fluidic channels not in the first set of fluidic channels, thereby preventing fluids from the fluidic channels not in the first set of fluidic channels from diffusing into the reaction chamber.

9. The microfluidic device according to claim 8, wherein the controller is programmed for, during a target reaction, maintaining a continuous flow of reagents into the reaction chamber and an equal continuous flow out of the reaction chamber, and wherein the controller is programmed for providing the continuous flow of reagents into the reaction chamber through inlets from the first set of fluid channels and for providing the equal continuous flow out of the reaction chamber through outlets in fluidic channels of reagents not involved in the target reaction.

10. A microfluidic system comprising a plurality of microfluidic devices, wherein each of the microfluidic devices comprises:

a reaction chamber allowing reacting of at least one fluid material; and at least two fluidic channels coupled to the reaction chamber for providing a fluid to and exiting a fluid from, respectively, the reaction chamber, wherein each fluidic channel comprises an inlet and an outlet, wherein each fluidic channel is configured such that when a first fluid is provided in the reaction chamber via that fluidic channel, the first fluid exits the reaction chamber via the outlet of at least one other fluidic channel when the reaction chamber is filled, thereby preventing a second fluid from the at least one other fluidic channel, when present in the inlet, from diffusing into the reaction chamber, and wherein the reaction chambers from each of the microfluidic devices are positioned in an array.

11. The microfluidic system according to claim 10, wherein the microfluidic system is a diagnostic system.

12. The microfluidic system according to claim 11, wherein the microfluidic system comprises at least one microfluidic device comprising five reagent inlets for performing DNA sequencing.

13. The microfluidic system according to claim 10, wherein each of the microfluidic devices further comprises a wash-buffer channel for flushing the reaction chamber.

14. The microfluidic system according to claim 13, wherein each fluidic channel of a respective microfluidic device is configured such that when a wash buffer is provided in the respective reaction chamber via the respective wash-buffer channel, the wash buffer exits the respective reaction chamber via the respective outlet of each respective fluidic channel when the respective reaction chamber is filled, thereby preventing the first fluid and the second fluid, when present in the respective inlets of the respective fluidic channels, from diffusing into the respective reaction chamber.

15. The microfluidic system according to claim 10, wherein the inlets and the outlets of the at least two fluidic channels of each of the microfluidic devices have a fluidic resistance to limit diffusion of unwanted reagents into the respective reaction chamber.

16. The microfluidic system according to claim 10, wherein a respective cavity is formed in each of the microfluidic devices by the respective reaction chamber having a corner-free shape.

17. The microfluidic system according to claim 10, wherein, for each of the microfluidic devices, each of the respective inlets has a same shape, geometry, or fluidic resistance.

* * * * *